US005917524A

United States Patent [19]

Kimura et al.

[11] Patent Number: 5,917,524

[45] **Date of Patent: *Jun. 29, 1999**

[54] INK TANK WITH SECURE MOUNTING ARRANGEMENT

[75] Inventors: Makiko Kimura, Sagamihara; Tsutomu Abe, Isehara; Akio Saito, Hadano; Hiroshi Nakagomi, Yamato, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,632

[22] Filed: Mar. 19, 1996

Related U.S. Application Data

[62] Division of application No. 08/186,885, Jan. 26, 1994, Pat. No. 5,515,091, which is a continuation of application No. 08/115,664, Sep. 2, 1993, abandoned, which is a continuation of application No. 07/906,456, Jun. 30, 1992, abandoned, which is a continuation of application No. 07/463,482, Jan. 11, 1990, Pat. No. 5,155,502.

[30] Foreign Application Priority Data

Jan. 13, 1989 [JP] Japan ..... 1-7407

[51] Int. Cl.[6] ..... B41J 2/175; B41J 2/05

[52] U.S. Cl. ..... 347/86

[58] Field of Search ..... 347/86, 87, 49

[56] References Cited

U.S. PATENT DOCUMENTS

| | | | |
|---|---|---|---|
| 3,967,286 | 6/1976 | Andersson et al. | 347/87 |
| 4,306,245 | 12/1981 | Kasugayama et al. | 347/87 X |
| 4,313,124 | 1/1982 | Hara . | |
| 4,345,262 | 8/1982 | Shirato et al. . | |
| 4,368,478 | 1/1983 | Koto | 347/86 |
| 4,419,678 | 12/1983 | Kasugayama | 347/86 |
| 4,459,600 | 7/1984 | Sato et al. . | |
| 4,463,359 | 7/1984 | Ayata et al. . | |
| 4,477,823 | 10/1984 | Matsufuji | 347/42 X |
| 4,558,333 | 12/1985 | Sugitani et al. . | |
| 4,633,274 | 12/1986 | Matsuda | 347/87 |
| 4,712,172 | 12/1987 | Kiyohara et al. | 347/87 |
| 4,723,129 | 2/1988 | Endo et al. . | |
| 4,740,796 | 4/1988 | Endo et al. . | |
| 4,771,295 | 9/1988 | Baker et al. | 347/87 |
| 4,775,871 | 10/1988 | Abe et al. . | |
| 4,969,759 | 11/1990 | Suzuki et al. | 400/124 |

(List continued on next page.)

FOREIGN PATENT DOCUMENTS

| | | | |
|---|---|---|---|
| 0139508 | 5/1985 | European Pat. Off. . | |
| 0261764 | 3/1988 | European Pat. Off. | B41J 27/18 |
| 2575413 | 7/1986 | France | B41J 3/04 |
| 59-123670 | 7/1984 | Japan | B41J 3/04 |
| 59-138461 | 8/1984 | Japan | B41J 3/04 |
| 61-012352 | 1/1986 | Japan | B41J 3/04 |
| 61-249757 | 11/1986 | Japan | B41J 3/04 |
| 363003958 | 1/1988 | Japan | B41J 3/04 |
| 63-009544 | 1/1988 | Japan | B41J 3/04 |
| 63-022653 | 1/1988 | Japan | B41J 3/04 |
| 2203386 | 10/1988 | United Kingdom | B41J 3/04 |

*Primary Examiner*—Joseph Hartary
*Attorney, Agent, or Firm*—Fitzpatrick, Cella, Harper & Scinto

[57] ABSTRACT

An ink tank is removably mountable to an ink jet head body having a discharge opening for discharging ink, an ink communication pipe for introducing ink to an ink jet head, and a first coupling member. The ink tank comprises a container body for storing ink to be supplied to the ink jet head, an absorbent member disposed in the container body for holding ink, and an ink supply port into which the ink communication pipe is inserted when the ink tank is connected with the ink jet head body. The ink tank includes a first engagement member to connect and engage with the coupling member when the ink tank is connected with the ink jet head body and a second engagement member to contact and engage a part of the ink jet head body when the ink tank is connected with the ink jet head body.

12 Claims, 4 Drawing Sheets

U.S. PATENT DOCUMENTS 5,095,321 3/1992 Saito et al. .
5,155,502 10/1992 Kimura et al. ..... 347/87
5,156,470 10/1992 Suzuki et al. ..... 400/124
5,156,471 10/1992 Suzuki et al. ..... 400/124
5,156,472 10/1992 Suzuki et al. ..... 400/124
5,156,473 10/1992 Suzuki et al. ..... 400/124
5,158,377 10/1992 Suzuki et al. ..... 400/124
5,174,665 12/1992 Suzuki et al. ..... 400/124
5,182,581 1/1993 Kashimura et al. ..... 347/87
5,221,148 6/1993 Suzuki et al. ..... 400/124
5,328,279 7/1994 Suzuki et al. ..... 400/124
5,421,658 6/1995 Suzuki et al. ..... 400/124
5,515,091 5/1996 Kimura ..... 347/86

INK TANK WITH SECURE MOUNTING ARRANGEMENT

This application is a division of application Ser. No. 08/186,885 filed Jan. 26, 1994, now U.S. Pat. No. 5,515,041, which in turn is a continuation of application Ser. No. 08/115,664, filed Sep. 2, 1993, now abandoned, which in turn is a continuation of application Ser. No. 07/906,456, filed Jun. 30, 1992, now abandoned, which in turn is a continuation of application Ser. No. 07/463,482, filed Jan. 11, 1990, now U.S. Pat. No. 5,155,502.

BACKGROUND OF THE INVENTION

1. Field of the Invention

The present invention relates to a liquid discharge or spray recording head and, more particularly, to a liquid spray recording head (to be also referred to as an "ink-jet cartridge" hereinafter) integrally formed with an ink storage portion (to be also referred to as an "ink tank" hereinafter) serving as a supply source of a recording liquid (to be also referred to as an "ink" hereinafter).

2. Related Background Art

A conventional liquid spray recording apparatus (to be also referred to as an "ink-jet printer" hereinafter) comprises a recording head for discharging or injecting an ink onto a recording medium and an ink supply source which is separately arranged at a remote position to supply an ink to the recording head. The recording head and the ink supply source are connected through an ink supply system including a supply pipe and the like.

Since an ink-jet printer of this type generally requires a long supply pipe, cumbersome connections are involved in assembly, and evaporation of the ink and formation of air bubbles in the ink tend to occur.

There has been propose an ink-jet printer in which a head and an ink supply source are constituted by an integral unit, as disclosed in Japanese Patent Application No. 60-91236 (Japanese Patent Laid-Open No. 61-249757). Japanese Patent Application No. 61-165667 (Japanese Patent Laid-Open No. 63-22653, Japanese Patent Application No. 63-275793, and the like. In such a proposal, ink evaporation and formation of air bubbles in the ink can be eliminated. In addition, piping is not required. Handling of an ink supply system including the head and the ink supply source can be facilitated.

The process for manufacturing the above recording head includes a step of connecting a recording head body to an ink tank. In this case, easy mounting at the time of connection between the head body and the ink tank and a stable ink flow in a mounted state must be assured.

SUMMARY OF THE INVENTION

It is an object of the present invention to provide an ink-jet recording head wherein a recording head body can be easily connected to an ink tank, and a stable ink flow is assured in a mounted state.

It is another object of the present invention to provide an ink tank removably mountable to an ink jet head body having a discharge opening for discharging ink therefrom, an ink communication pipe for introducing the ink to an ink jet head, and a first coupling member, the ink tank comprising a container body for storing the ink to be supplied to the ink jet head, an absorbent member disposed in the container body for holding the ink, an ink supply port into which the ink communication pipe is inserted when the ink tank is connected with the ink jet head body, a first engagement member for connection with the coupling member when the ink tank is connected with the ink jet head body to connect the ink jet head body and the ink tank, and a second engagement member for contact with a part of the ink jet head body when the ink tank is connected with the ink jet head body.

DETAILED DESCRIPTION OF THE PREFERRED EMBODIMENT:

The present invention will be described in detail with reference to the accompanying drawings.

Figure 1A:
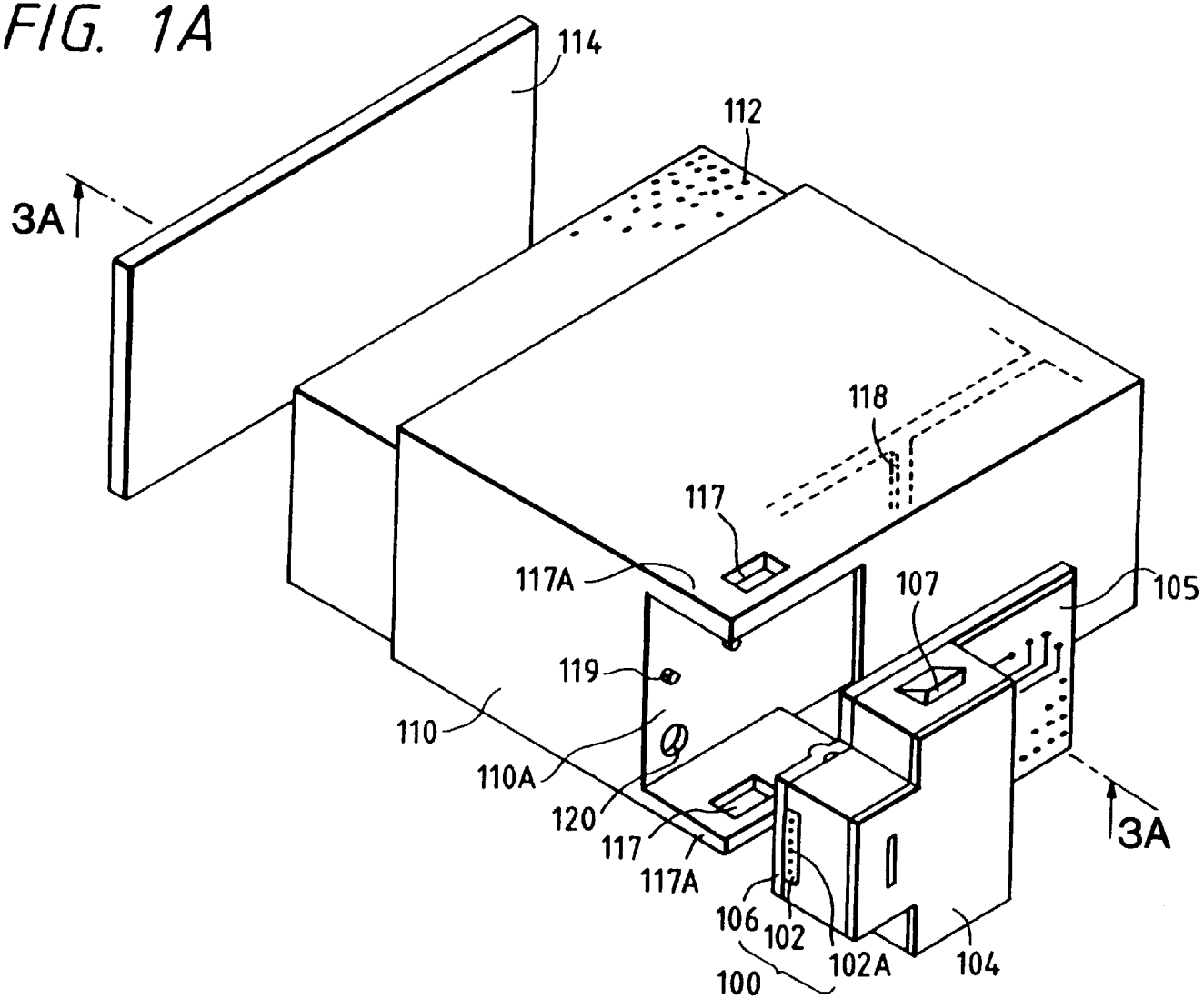
FIGS. 1A and 1B are an exploded perspective view and a perspective view showing an arrangement of an ink-jet recording head according to an embodiment of the present invention.
Figure 1B:
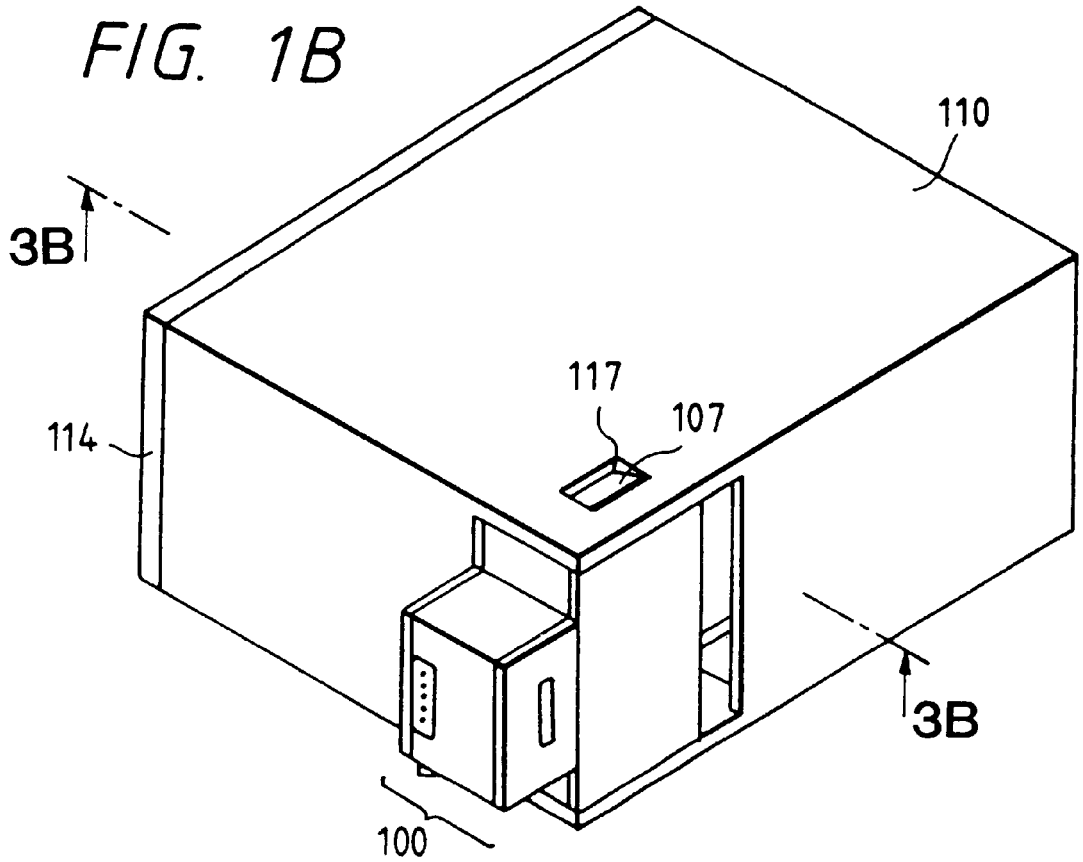

FIGS. 1A and 1B show an ink-jet recording head according to an embodiment of the present invention. More specifically, the ink-jet recording head is a disposable head in which an ink tank serving as an ink storage member is formed integrally with a recording head element.

A recording head element 100 includes an injection portion 102, a supply tank portion 104, a wiring board 105 having a wiring pattern for transmitting a signal for driving energy generating elements for generating energy for injecting an ink, and a base plate 106 for supporting the injection portion 102, the supply tank portion 104, and the wiring board 105. The injection portion 102 includes injection ports 102A formed in a surface opposite to a recording medium, liquid paths formed inside the injection portion 102, injection energy generating elements such as electricity-heat converters, and a common liquid chamber communicating with the respective liquid paths. The liquid paths and the common liquid chamber constitute an ink path. The supply tank portion 104 serves as a subtank for receiving an ink from an ink tank 110 and supplying it to the common liquid chamber in the injection portion 102. The base plate 106 is made of aluminum or the like and also serves as a heat radiation plate for suppressing heat generation of the head element upon driving of the electricity-heat converters.

An ink absorbing member 112 is arranged inside the ink tank 110 and is made of a porous material or fibers. A cover member 114 covers the ink tank 110.

Projections 107 are formed on the head element 100 and have tapered portions which facilitate connection with the ink tank 110. An opening 117 is formed in each wall portion 117A of an element storage portion 110A of the ink tank 110 and engaged with the corresponding projection 107 to couple the head element 100 to the ink tank 110. An abutment member 118 is formed in the element storage portion 110A to facilitate mounting of the head element 100 and assure its mounted state. The abutment member 118 is engaged with the rear end face of the base plate 106. A projection 119 positions the head element 110. A supply port 120 supplies an ink from the ink tank 110 to the head element 100. The detailed structure of these members will be described later.

An ink-jet printer (FIG. 2) using the ink-jet recording head having the above arrangement, i.e., an ink-jet printer using a disposable cartridge recording head, can be obtained.

Figure 2:
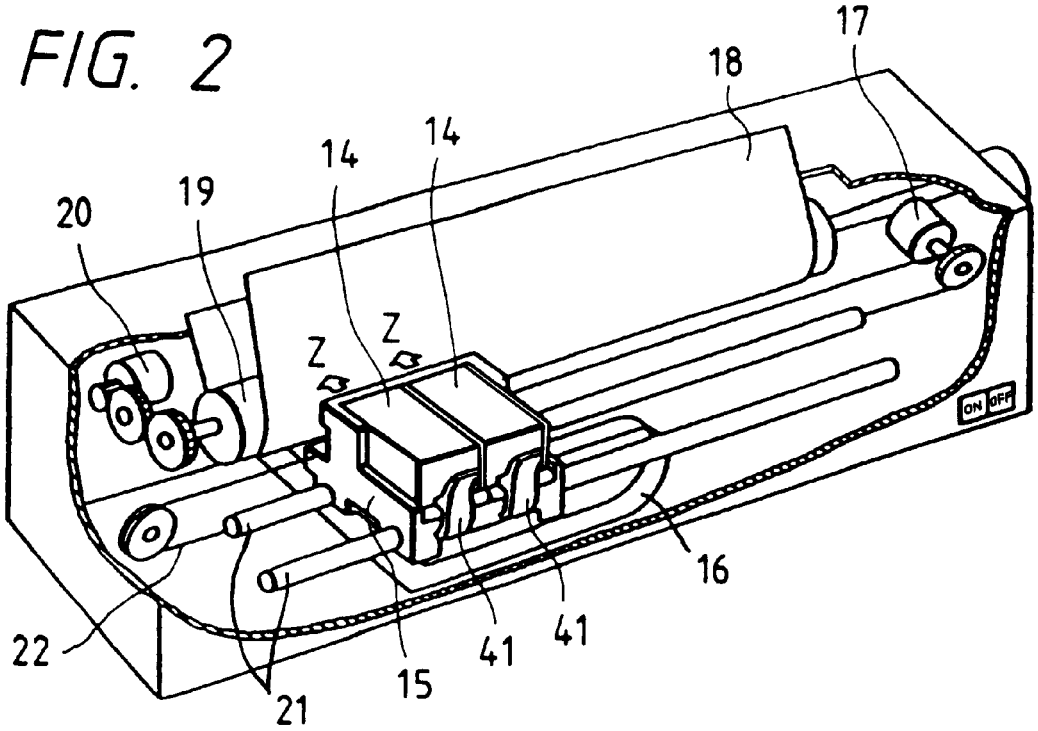
FIG. 2 is a perspective view showing an arrangement of an ink-jet printer using the recording head shown in FIGS. 1A and 1B.

Referring to FIG. 2, the printer includes cartridge recording heads 14 shown in FIGS. 1A and 1B. The recording heads 14 are fixed on a carriage 15 by press members 41 and are reciprocally moved along shafts 21 in the longitudinal direction of the printer. Positioning of the recording heads 14 can be performed by the hole formed on each recording head element 100 and a corresponding dowel formed on the carriage 15.

An ink injected from each recording head reaches a recording medium 18 located on a platen 19 spaced apart from the recording head by a small gap, thereby forming an image on the recording medium 18.

Injection signals corresponding to image data are supplied from an appropriate data supply source to the recording heads through a cable 16 and terminals connected to the cable 16. At least one cartridge 14 (two cartridges in FIG. 2) can be arranged in accordance with the number of colors of inks to be used.

Referring to FIG. 2, the printer also includes a carriage motor 17 for driving the carriage 15 along the shafts 21, and a wire 22 for transmitting a driving force of the motor 17 to the carriage 15. In addition, a feed motor 20 is connected to the platen 19 to feed the recording medium 18.

Figure 3A:
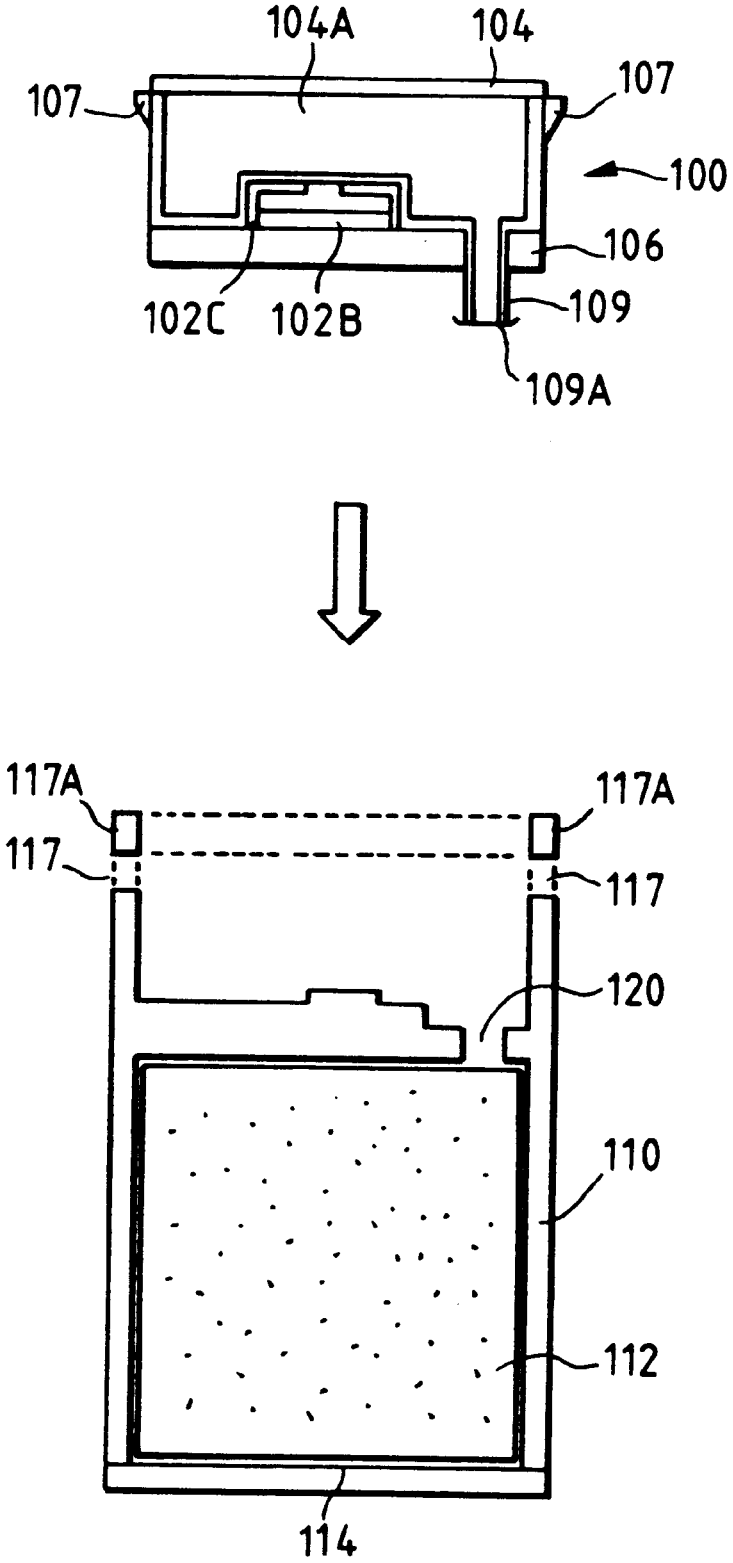
FIGS. 3A and 3B are sectional views showing a method of connecting a recording head element and an ink tank shown FIGS. 1A and 1B.
Figure 3B:
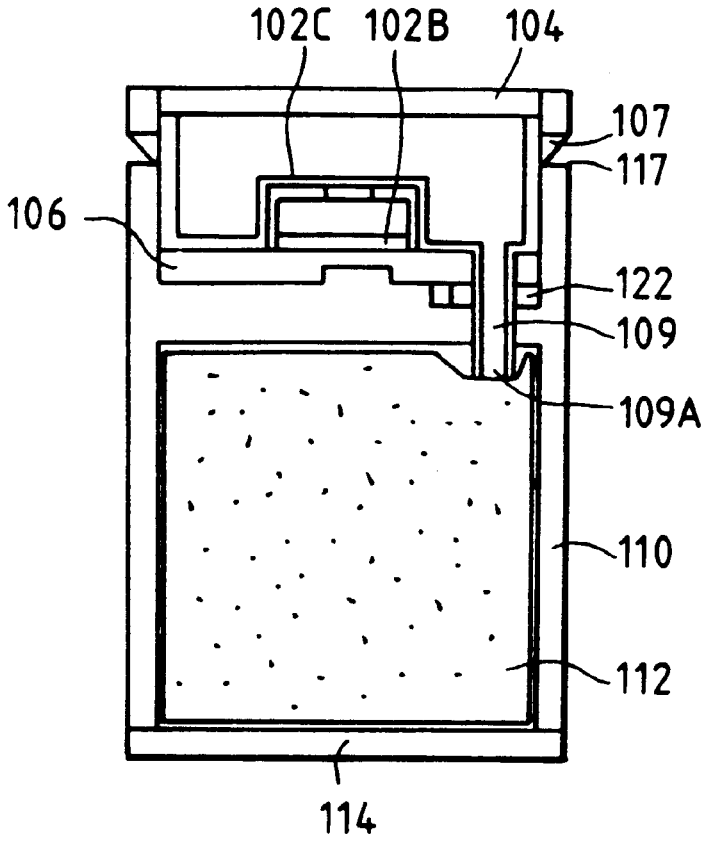

FIGS. 3A and 3B are sectional views taken along the lines A—A of FIGS. 1A and 1B, respectively. A method of mounting the head element 100 on the ink tank 110 will be described with reference to FIGS. 3A and 3B.

Referring to FIGS. 3A and 3B, a communication pipe 109 is connected from the supply tank portion 104 of the head element 100 and extends through the base plate 106. The communication pipe 109 can extend into the ink tank 110 through a supply port 120. A filter 109A is mounted at the distal end of the communication pipe 109 to prevent air bubbles from entering from the ink tank 110 to a supply tank chamber 104A. A heater board 102B has electricity-heat converters (heaters) as injection energy generation elements thereon. A top plate 102C is combined with the heater board 102B to constitute the injection portion 102. Therefore, the injection ports 102A, the liquid paths communicating with them, and the common liquid chamber for receiving ink from the supply tank chamber 104A and supplying it to the respective ink paths are formed.

In order to connect the head element 100 to the ink tank 110, the head element 100 is mounted on the ink tank 110 in a direction indicated by an arrow in FIG. 3A. At this time, upon engagement of the tapered surface of the projection 107 and the opening 117 formed in the wall portion 117A of the ink tank 110, the wall portion 117A is widened outward. At the same time, the communication pipe 109 enters into the supply port 120.

When the projection 107 is located at a position perfectly opposite to the opening 117, the wall portion 117A returns to the initial position by its spring force. The projection 107 is perfectly fitted in the opening 117 to obtain a mounted state shown in FIG. 3B. The guide port at the distal end of the communication pipe 109 abuts against the absorbing member 112, thereby obtaining good ink communication. In FIG. 3B, an O-ring 122 serves as a sealing member for appropriately sealing the ink at the supply port 120.

With the above arrangement, the head element 100 can be connected to the ink tank 110 by simply inserting the head element 100 into the ink tank 110 in the direction indicated by the arrow in FIG. 3A without requiring any operation such as adhering. In addition, the communication pipe 109 connected to the head element 100 is inserted into the ink tank 110, and its distal end abuts against the ink absorbing member 112, thereby assuring the ink communication state.

In the above arrangement, the projections 107 are formed on the head element, and the openings 117 are formed in the wall portions 117A of the ink tank 110. During mounting, the projection 107 is engaged with the opening 117 by utilizing flexibility or elasticity of the wall portion 117A. However, this arrangement may be arbitrarily modified. For example, the wall portion 117A need not have flexibility. Even if the wall portion 117A is rigid, the projection 107 may be supported by a spring or the like and biased outward. In this case, the projection 107 is retracted inward during mounting. When the projection 107 opposes the opening 117, it is fitted in the opening 117 by the biasing force of the spring.

In this embodiment, the head element 100 is formed integrally with a relatively elongated base plate 106. By utilizing this portion, mounting operations including positioning can be further facilitated, and the mounted state can be further guaranteed.

Figure 4:
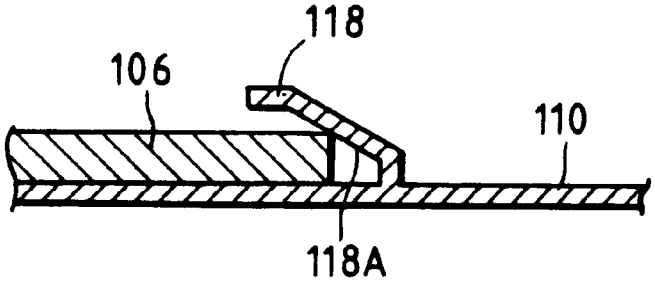
FIG. 4 is a view for explaining a member for assuring a state of connection between the recording head element and the ink tank.

FIG. 4 shows a structure for the above purpose. In this embodiment, a surface of an abutment member 118 formed in the element storage portion 110A of the ink tank 110 is a tapered surface 118A against which the rear end of the base plate 106 abuts. In the abutted state shown in FIG. 4, the projections 107 are positioned with the openings 117, the positioning projection 119 is aligned with a hole (not shown) formed in the base plate 106, and the communication pipe 109 is aligned with the opening 120.

More specifically, when the head element 110 is to be mounted on the ink tank 110, the rear end of the base plate 106 abuts against the tapered surface 118A of the abutment member 118. In this state, the operations shown in FIGS. 3A and 3B are performed to connect the head element 100 to the ink tank 110. In addition to fitting of the projections 107 into the openings 117, the rear end of the base plate 106 is urged against the ink tank 110 by the tapered surface 118A, thereby further assuring a stable mounted state.

As described above, according to this embodiment, the recording head element can be appropriately connected to the ink tank by a simple operation. At the same time, a good ink communication state can be obtained. Therefore, the process for manufacturing the recording head can be simplified, and the manufacturing cost becomes low. When the ink is consumed to a very small amount or runs out, the head element which is more expensive than other members constituting the ink tank need not be replaced. The user may replace only the ink tank, thereby reducing maintenance expenses.

According to the present invention as has been described above, there is provided an ink-jet recording head wherein a recording head body (head element) can be easily connected to the ink tank, and a stable ink communication state in the mounted state can be obtained.

According to the present invention, the energy generating element for generating energy for injecting an ink may comprise a heating element serving as an electricity-heat converter having a heating resistor and electrodes connected to the heating resistor, or a piezoelectric element serving as an electromechanical converter.

In the ink-jet head used in the present invention, the direction for injecting an ink from the injection ports may be the same as or different (e.g., perpendicular to each other) from the direction for supplying an ink to the position in the ink path where the energy generating element is arranged.

The present invention brings about excellent effects particularly in a recording head, recording device of the bubble jet system among the ink jet recording system.

As to its representative constitution and principle, for example, one practiced by use of the basic principle disclosed in, for example, U.S. Pat Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on an electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristics. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. No. 4,558,333or 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat convertors as the discharging portion of the electricity-heat converter or Japanese Patent Laid-Open Application No. 59-138461 which discloses the constitution having the opening for absorbing pressure wave of heat energy correspondent. to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above-further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

We claim:

1. An ink tank removably mountable to a recording head, the recording head having a discharge portion, a common liquid chamber, an ink supply pipe, a wiring substrate provided with wiring for transmitting a signal for driving an energy generating element disposed at said discharge portion, and a base plate for supporting said discharge portion, said common liquid chamber, said ink supply pipe and said wiring substrate, said ink tank comprising:

an ink tank body provided with an ink supply opening into which said ink supply pipe is inserted;

an ink absorbing member for holding ink, the ink absorbing member being contained inside said ink tank body;

a securely arranged abutment member contactable to a rear end edge of said base plate of said recording head; and a securely arranged positioning projection member engageable with a portion of a side surface of the base plate of said recording head, the positioning projection member being a reference for positioning said recording head with respect to said ink tank.

2. An ink tank according to claim 1, wherein in a connected state of the recording head and said ink tanks a part of said ink absorbing member located at said ink supply opening port is compressed by a tip end of said ink supply pipe.

3. An ink tank according to claim 1, further comprising a filter disposed at a tip end of said ink supply pipe and being held in a compressed state to a part of said absorbing member located at said ink supply opening in a connected state of the recording head and said ink tank.

4. An ink tank according to claim 1, further comprising a wall formed by a part of said ink tank body around said ink supply opening.

5. An ink tank according to claim 1, wherein the recording head includes an energy generating element comprising an electricity-heat converter for generating heat energy.

6. An ink tank according to claim 1, wherein said absorbing member consists essentially of a porous material.

7. An ink tank according to claim 1, wherein said absorbing member consists essentially of fibers.

8. An ink tank according to claim 1, wherein the recording head includes an energy generating element comprising an electromechanical converter including a piezoelectric element.

9. An ink tank according to claim 1, wherein the recording head includes a full-line type head having a plurality of discharge openings in correspondence with a width of a recording medium.

10. A method of mounting a recording head onto an ink tank, said recording head having a base plate, an ink supply pipe, and an engagement portion, said ink tank having a securely arranged abutment member, an ink supply opening, a securely arranged positioning projection member that is a reference for positioning said recording head with respect to said ink tank, and a locking portion, the method comprising the steps of:

abutting a rear end edge of the base plate of said recording head against the securely arranged abutment member of said ink tank;

positioning the securely arranged positioning projection member of said ink tank in an opening provided in the base plate of said recording head;

inserting the ink supply pipe of said recording head into the ink supply opening of said ink tank; and securing said recording head to said ink tank by engaging the engagement portion of said recording head with the locking portion of said ink tank.

11. A method of mounting a recording head onto an ink tank according to claim 10, wherein the securely arranged abutment member has a tapered face.

12. An ink tank according to claim 1, wherein the securely arranged abutment member has a tapered face.

* * * * *

UNITED STATES PATENT AND TRADEMARK OFFICE

CERTIFICATE OF CORRECTION

PATENT NO. : 5,917,524

DATED : June 29, 1999

INVENTOR(S) : Makiko Kimura, et al.

It is certified that error appears in the above-identified patent and that said Letters Patent is hereby corrected as shown below:

ON THE TITLE PAGE

At [56], References Cited, Foreign Patent Documents, '363003958" should read --63-003958--.

OLUMN 1

Line 35, "propose" should read --proposed--;
Line 37, "Japanese Patent Application No. 60-91236" hould be deleted;
Line 38, "(Japanese" should read --Japanese--; and "61-49757). Japanese" should read --61-249757,--;
Line 39, "Patent Application No. 61-165667 (Japanese" hould read --Japanese--;
Line 40, "Japanese Patent Application No." should read -U.S. Patent 5,095,321,--; and
Line 41, "63-275793," should be deleted.

OLUMN 5

Line 31, "No. 4,558,333or" should read -No. 4,558,333 or--;
Line 42, "dent." should read --dent--; and
Line 50, "above-" should read --above--.

UNITED STATES PATENT AND TRADEMARK OFFICE

CERTIFICATE OF CORRECTION

PATENT NO. : 5,917,524

DATED : June 29, 1999

INVENTOR(S) : Makiko Kimura, et al.

It is certified that error appears in the above-identified patent and that said Letters Patent is hereby corrected as shown below:

OLUMN 6

Line 35, "tanks" should read --tank,--.

Signed and Sealed this

Eighteenth Day of April, 2000

*Attest:*

Q. TODD DICKINSON

*Attesting Officer*

*Director of Patents and Trademarks*